United States Patent [19]

Wanek

[11] 4,008,933

[45] Feb. 22, 1977

[54] BATHROOM ACCESSORY

[76] Inventor: Leonard F. Wanek, 301 2nd St. North, Breckenridge, Minn. 56520

[22] Filed: July 24, 1975

[21] Appl. No.: 598,682

[52] U.S. Cl. ..... 312/206; 312/42

[51] Int. Cl.[2] ..... A47B 81/02

[58] Field of Search ..... 312/42, 45, 206, 207

[56] References Cited

UNITED STATES PATENTS

| | | | |
|---|---|---|---|
| 2,750,246 | 6/1956 | Fuerst | 312/206 |
| 3,275,133 | 9/1966 | Wood | 312/42 |

FOREIGN PATENTS OR APPLICATIONS

| | | | |
|---|---|---|---|
| 804,356 | 7/1949 | Germany | 312/206 |

*Primary Examiner*—Casmir A. Nunberg
*Attorney, Agent, or Firm*—Burd, Braddock & Bartz

[57] ABSTRACT

A utilitarian and decorative piece of bathroom furniture adapted to provide a plurality of separate storage compartments for materials and devices used within the bathroom. The accessory is characterized by a central housing enclosing a storage compartment for several rolls of toilet tissue flanked on opposite sides by a compartment for storing several bars of soap on one side and for storing a toilet bowl brush on the other. The cover for the toilet tissue storage compartment is in the form of a further storage compartment for bath powder, or the like. According to one form of the invention, a drain cleaning plunger is concealed within the central storage housing.

5 Claims, 8 Drawing Figures

BATHROOM ACCESSORY

This invention relates to a piece of decorative and ornamental bathroom furniture for providing convenient storage for supplies and materials used in the bathroom and devices used therein. More particularly, the bathroom storage device, according to the present invention, comprises a plurality of separate storage compartments for surplus toilet tissue, surplus bar soap, toilet bowl cleaning brush, bath powder, drain cleaning plunger, and the like.

The invention is illustrated in the accompanying drawings in which.

Figure 1:
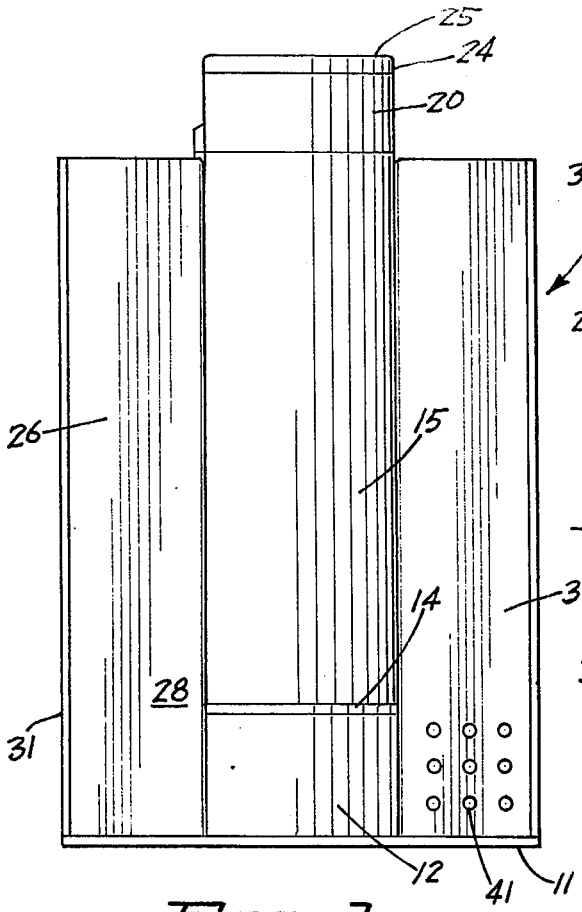
FIG. 1 is a side elevation of one form of bathroom storage accessory according to the present invention.
Figure 2:
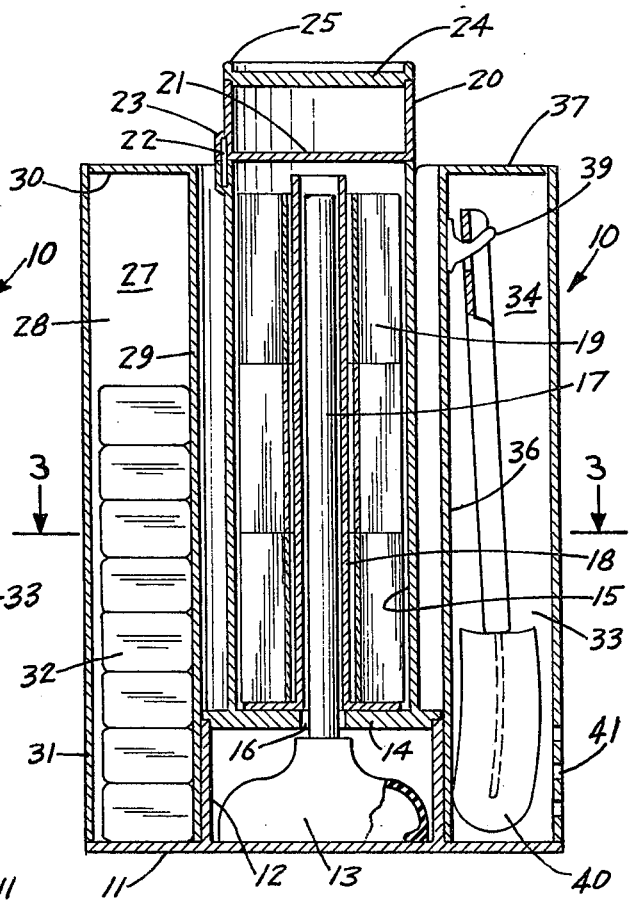
FIG. 2 is a longitudinal vertical section thereof.
Figure 3:
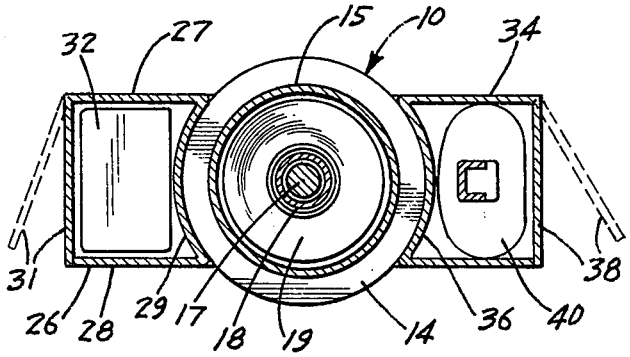
FIG. 3 is a horizontal section on the line 3—3 of FIG. 2 and in the direction of the arrows.

Referring now to the drawings, and particularly to FIGS. 1 through 4, the bathroom storage accessory, indicated generally at 10, includes a base 11 adapted to rest directly on a bathroom floor, or upon legs or feet if desired. A central open-topped cylindrical housing 12 is secured to the base, being of dimensions to receive the resilient rubber suction cup 13 of a drain cleaning plunger, a so-called "plumber's friend." A flanged circular disc 14 fits securely within the open top of housing 12 and functions as a cover for that housing.

Flanged disc 14 also functions as the bottom wall of a cylindrical toilet tissue compartment enclosed within an elongated vertical cylindrical housing 15. Cover disc 14 has a central opening 16 for receiving the handle 17 of the drain cleaning plunger. A central spindle 18 in the form of an elongated tube is secured to disc 14 in registry with hole 16. Spindle 18 is adapted to engage the core tubes of a plurality of stacked rolls of toilet tissue 19. Tissue storage housing 12 is open at the top.

Figure 4:
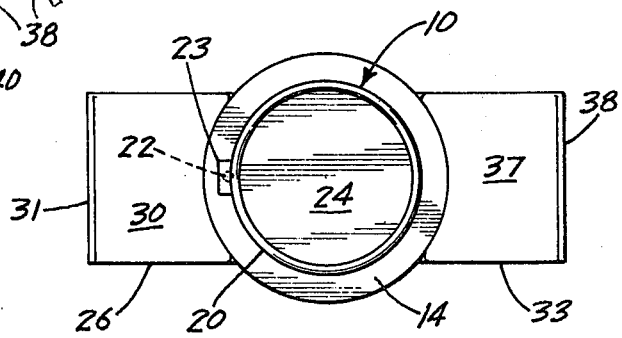
FIG. 4 is a top plan view showing the manner in which the topmost storage compartment is utilized as a removable cover for the toilet tissue storage compartment.
Figure 5:
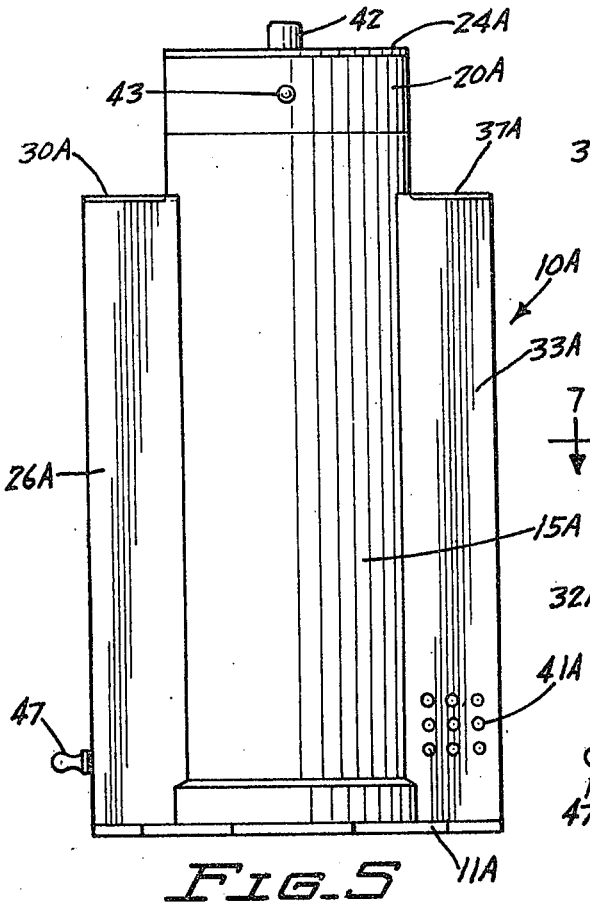
FIG. 5 is a side elevation of a modified form of bathroom storage accessory according to the present invention.
Figure 6:
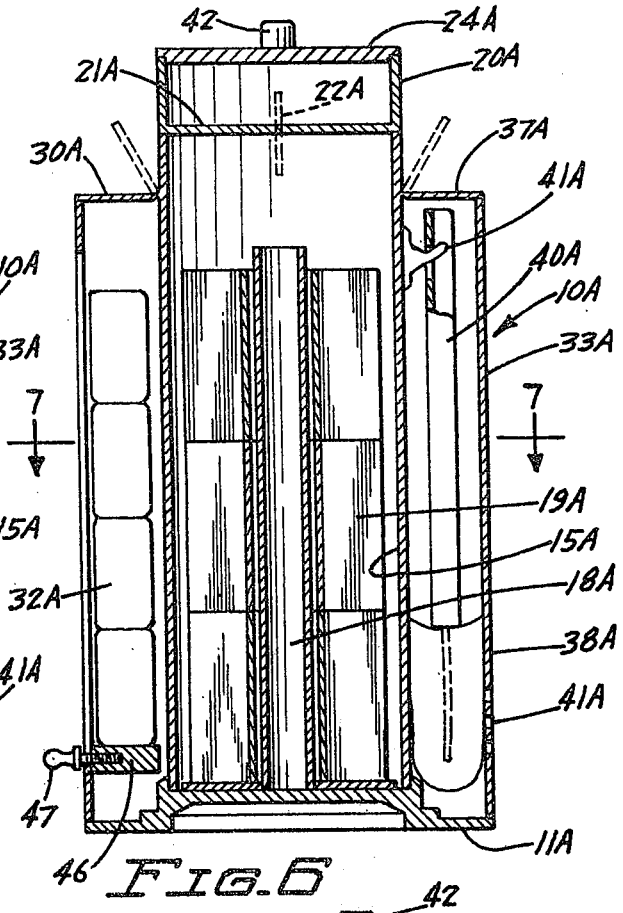
FIG. 6 is a longitudinal vertical section thereof.
Figure 7:
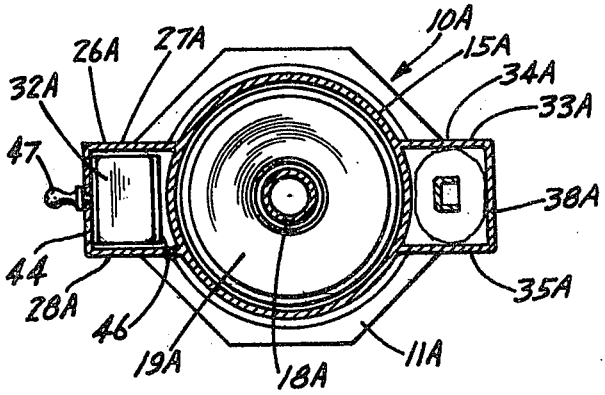
FIG. 7 is a horizontal section on the line 7—7 of FIG. 6.
Figure 8:
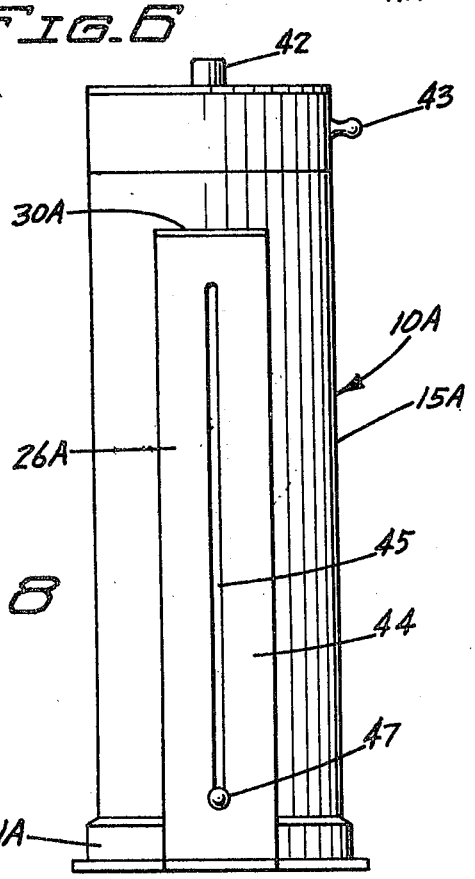
FIG. 8 is an end view of the modified form of accessory.

A further cylindrical housing 20 having a bottom wall 21 serves as a closure for the tissue storage compartment. Housing 20 may be utilized to store bath powder or other supplies. Housing 20 is removable. It may be provided with a recessed shoulder adapted to fit the top edge of tissue housing 15, but preferably it is hinged for movement in a horizontal plane, as seen in FIG. 4, by means of a vertical pivot hinge pin 22. Depending upon the thickness of the respective housing walls, pin 22 may be set in the wall or, if necessary, additional thickness may be provided as indicated at 23 to accommodate the pin without weakening the wall. The powder storage compartment may be rotated to provide full access to the tissue storage compartment for insertion and removal of toilet tissue rolls. Housing 20 is open at the top and provided with a flanged circular disc cover 24 which fits securely therein. Cover 24 may be provided with a knob handle or desirably, as illustrated, is provided with a rim or lip 25 around its perimeter permitting the cover to be used as a tray to hold an ash tray, a glass, or the like.

A soap storage compartment is enclosed within elongated vertical housing 26. Housing 26 rests upon base 11 and is formed generally from a pair of parallel side walls 27 and 28, arcuate back wall 29 and top wall 30. A door 31, suitably hinged to one of the side walls, provides access to the storage compartment. The soap storage compartment may be provided with a plurality of shelves for storage of supplies other than soap, or bars of soap 32 may simply be stacked therein.

A brush storage compartment is provided on the opposite side of the tissue storage compartment enclosed within housing 33 and of construction similar to that of the soap storage compartment. Thus, housing 33 is comprised of side walls 34 and 35, back wall 36, top wall 37, and hinged door 38. A hook 39 is provided within the housing to suspend a toilet bowl cleaning brush 40. Desirably openings are provided in the housing, as indicated at 41, to facilitate drying of the brush after use. If desired, an absorbent sponge may be placed in the bottom of the housing to catch any drip from the brush.

It will be seen that the storage accessory, according to the present invention, provides storage for those expendable supplies, such as toilet tissue and soap used in a bathroom. It provides accessible storage for bath powder, or the like. It provides storage for the normally difficult-to-store toilet bowl cleaning brush while keeping it readily available for use when needed. It provides concealed storage for the drain cleaning plunger, likewise difficult to store, particularly in an easily accessible place for emergency use when a drain becomes clogged. Although thoroughly concealed when not in use, the plunger is readily accessible simply by lifting the tissue storage compartment.

Referring now to FIGS. 5 through 8, there is shown an alternative form of bathroom storage accessory, according to the present invention. To the extent feasible, corresponding parts of this form of accessory are identified by the same numerals followed by the suffix A. Thus, the modified form of bathroom accessory 10A includes a base 11A supporting a central cylindrical housing 15A having a central spindle 18A for engaging a plurality of rolls of toilet tissue 19A.

A further cylindrical housing 20A of the same diameter having a bottom wall 21A functions as a cover for the toilet tissue storage compartment. Housing 20A is hingedly connected to housing 15A for pivotal movement in a horizontal plane by virtue of a pivot pin 22A, one end of which is set into the top side wall of chamber 15 and the other end of which is set into the corresponding bottom side wall of housing 20A. The compartment within housing 20A may be used for storing powder or other bathroom related supplies. It is provided with a top cover 24A provided in this instance with a knob 42. To facilitate rotation of housing 20A to provide access to the bathroom tissue storage compartment, a knob 43 may be provided.

The bathroom accessory includes a housing 26A supported by base 11A for the storage of bar soap. Housing 26A includes opposite side walls 27A and 28A and may share a common back wall with housing 15A. It has a front wall 44 having an elongated vertical slot 45 extending most of the length of the wall. An elevateable soap bar supporting platform 46 is positioned within housing 26A. The shank of an external knob handle 47 extends through slot 44 and engages platform 47. The housing top wall 30A is hinged to provide an access door to the housing. A plurality of bars of soap 32A may be inserted in the housing resting upon platform 46. When a new bar of soap is needed, the topmost bar is made accessible by raising the elevator platform 46 by means of handle 47 until the topmost bar emerges through hinged top wall 30A.

The bathroom accessory also has a housing 33A enclosing a brush storage compartment. The housing comprises parallel side walls 34A and 35A and front wall 38A. It shares a common back wall with tissue storage housing 15A and has a hinged top wall 37A to provide access for insertion and removal of a toilet bowl cleaning brush 40A. Desirably a hook or similar suspending support 41A is provided for the brush, either on the back wall of the housing or on the inside of the hinged top wall. Desirably vent holes 41A are provided in the portion of the housing walls adjacent to the brush bristles to facilitate drying of the brush when stored after use. If desired, an absorbent sponge may be inserted in the bottom of the housing to catch any water which may drip from the brush.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A bathroom storage accessory comprising:

A. a base adapted to rest upon a floor,

B. a central toilet tissue storage compartment supported on said base, said compartment having an elongated vertical housing open at the top and an elongated central spindle within the housing adapted to engage a plurality of rolls of toilet tissue, C. a further removable storage compartment of generally the same cross-sectional configuration overlying said tissue storage compartment and supported at the top thereof to function as a cover therefor, D. a removable cover for said further storage compartment of generally the same cross-sectional configuration E. a brush storage compartment supported on said base on one side of said tissue storage compartment adjacent thereto, said compartment having an elongated vertical housing, an access door to said housing and hook means within the housing for suspending a brush therefrom, and F. a bar soap storage compartment supported on said base on the opposite side of said central tissue storage compartment and adjacent thereto, said compartment having an elongated vertical housing and an access door to said housing.

2. A bathroom accessory according to claim 1 further characterized in that:

A. said toilet tissue storage compartment is removably supported on said base overlying a central open-topped drain plunger storage compartment adapted to receive the rubber suction cup of a drain cleaning plunger, B. said tissue storage housing has a horizontal bottom wall adapted to function as a cover for said plunger storage compartment, C. said bottom wall has a central opening therein, and D. said spindle is hollow and in registry with said opening to receive the handle of a drain plunger.

3. A bathroom accessory according to claim 2 further characterized in that said plunger storage compartment, said tissue storage compartment and said further storage compartment overlying said tissue storage compartment are of circular cross-section.

4. A bathroom accessory according to claim 1 further characterized in that the top of said tissue storage compartment extends at least as high as the top of said soap and brush storage compartments and said further storage compartment is hingedly connected to said tissue storage compartment by means of a vertical pin hinge for relative pivotal movement in a horizontal plane.

5. A bathroom accessory to claim 1 further characterized in that:

A. one vertical wall of said soap storage compartment is provided with a longitudinal slot extending from adjacent the bottom thereof to adjacent the top thereof, B. a soap supporting elevator platform is disposed within said housing, C. said compartment has a hinged top access door, and D. an external handle is secured to said elevator platform through said slot to permit raising said platform for discharge of soap through said access door.

* * * * *

UNITED STATES PATENT AND TRADEMARK OFFICE

CERTIFICATE OF CORRECTION

PATENT NO. : 4,008,933

DATED : February 22, 1977

INVENTOR(S) : Leonard F. Wanek

It is certified that error appears in the above-identified patent and that said Letters Patent are hereby corrected as shown below:

Column 4, Claim 5, line 1, after "accessory", --according-- is omitted.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*